US008689907B2

(12) United States Patent
Lu

(10) Patent No.: US 8,689,907 B2
(45) Date of Patent: Apr. 8, 2014

(54) PATTERNED TEXTURING OF THE SEAL SURFACE FOR A ROLLER CONE ROCK BIT

(75) Inventor: Xiaobin Lu, Coppell, TX (US)

(73) Assignee: Varel International Ind., L.P., Carrollton, TX (US)

( * ) Notice: Subject to any disclaimer, the term of this patent is extended or adjusted under 35 U.S.C. 154(b) by 586 days.

(21) Appl. No.: 12/845,451

(22) Filed: Jul. 28, 2010

(65) Prior Publication Data

US 2012/0024608 A1 Feb. 2, 2012

(51) Int. Cl.
*E21B 10/00* (2006.01)
*F16C 33/72* (2006.01)

(52) U.S. Cl.
USPC ..... 175/371; 175/372; 384/94

(58) Field of Classification Search
USPC ..... 175/371, 372, 337; 277/334, 401; 384/94
See application file for complete search history.

(56) References Cited

U.S. PATENT DOCUMENTS

| | | | | |
|---|---|---|---|---|
| 2,697,014 | A | 12/1954 | Boice et al | |
| 3,839,774 | A | 10/1974 | Jackson, Jr. | |
| 4,037,673 | A * | 7/1977 | Justman | 175/371 |
| 4,248,485 | A | 2/1981 | White et al. | |
| 4,619,534 | A | 10/1986 | Daly et al. | |
| 4,708,752 | A | 11/1987 | Kar | |
| 5,362,073 | A * | 11/1994 | Upton et al. | 277/589 |
| 5,485,890 | A | 1/1996 | Cawthorne et al. | |
| 5,535,838 | A | 7/1996 | Keshavan et al. | |
| 5,592,840 | A | 1/1997 | Miyasaka | |
| 5,816,088 | A | 10/1998 | Yamada et al. | |
| 5,944,125 | A | 8/1999 | Byrd | |
| 6,446,520 | B1 | 9/2002 | Nagai et al. | |
| 6,508,093 | B2 | 1/2003 | Berthelet et al. | |
| 6,598,689 | B1 | 7/2003 | Slaughter, Jr. et al. | |
| 6,881,500 | B2 | 4/2005 | Sugiyama | |
| 7,036,613 | B2 * | 5/2006 | Burr | 175/371 |
| 7,052,400 | B2 | 5/2006 | Kura et al. | |
| 7,128,171 | B2 | 10/2006 | Dick et al. | |
| 7,338,379 | B2 | 3/2008 | Mancuso et al. | |
| 7,582,174 | B2 | 9/2009 | Vigneau | |
| 7,703,312 | B2 | 4/2010 | David | |
| 7,708,090 | B2 * | 5/2010 | Zahradnik et al. | 175/371 |
| 7,721,827 | B2 * | 5/2010 | Gallifet et al. | 175/372 |
| 7,735,583 | B2 * | 6/2010 | Lin | 175/371 |
| 7,762,113 | B2 | 7/2010 | Prevey, III | |
| 8,062,094 | B2 | 11/2011 | Cisek et al. | |

(Continued)

FOREIGN PATENT DOCUMENTS

| | | | |
|---|---|---|---|
| WO | WO-03040591 | A1 | 5/2003 |
| WO | WO-2007146276 | A1 | 12/2007 |

OTHER PUBLICATIONS

Shot Peening Applications, Metal Improvement Company, Inc., Seventh Edition, "Intensity Control" for J.O. Almen Fixture (cover page and pp. 61-62).

(Continued)

*Primary Examiner* — Kenneth L Thompson
*Assistant Examiner* — Michael Wills, III
(74) *Attorney, Agent, or Firm* — Gardere Wynne Sewell LLP; Andre M. Szuwalski

(57) ABSTRACT

Surface texturing is employed to modify the topography of one or more surfaces (radial or cylindrical) of the sealing system for a roller cone rock bit. The surface texturing produces a regular or repeated patterned dimpled surface which retains additional lubricant helpful in reducing friction in the boundary and mixed lubrication regimes.

28 Claims, 4 Drawing Sheets

(56) References Cited

U.S. PATENT DOCUMENTS

| | | | | |
|---|---|---|---|---|
| 2003/0029645 | A1* | 2/2003 | Mourik et al. | 175/372 |
| 2004/0265620 | A1 | 12/2004 | Sugiyama | |
| 2005/0252691 | A1 | 11/2005 | Bramlett et al. | |
| 2006/0243494 | A1* | 11/2006 | Koltermann et al. | 175/228 |
| 2007/0081747 | A1 | 4/2007 | Dick et al. | |
| 2007/0284150 | A1* | 12/2007 | Lin | 175/371 |
| 2008/0073124 | A1* | 3/2008 | Lin | 175/371 |
| 2008/0099244 | A1* | 5/2008 | Chellappa et al. | 175/57 |
| 2009/0045585 | A1* | 2/2009 | Gallifet et al. | 277/403 |
| 2009/0232428 | A1* | 9/2009 | Lu | 384/95 |
| 2009/0232434 | A1* | 9/2009 | Lu | 384/477 |
| 2010/0038144 | A1* | 2/2010 | Stauffer | 175/371 |
| 2010/0071960 | A1* | 3/2010 | Curry et al. | 175/371 |
| 2010/0089657 | A1* | 4/2010 | Lin | 175/371 |
| 2011/0048810 | A1* | 3/2011 | Lin et al. | 175/371 |

OTHER PUBLICATIONS

SG Written Opinion dated Dec. 13, 2011 for SG 201006654-6 (11 pages).

Singapore Written Opinion mailed Sep. 21, 2011 for SG 201006656-1 (13 pages).

Wang, Jane Q., et al., "Virtual Texturing: Modeling the Performance of Lubricated Contacts of Engineered Surfaces", Transactions of the ASME, vol. 127, Oct. 2005, pp. 722-728.

Etsion, I et al., "Analytical and Experimental Investigation of Laser-Textured Mechanical Seal Faces", Tribology Transactions, vol. 42, (1999), 3, pp. 511-516.

Xiaobin, Lu et al., "An Experimental Investigation of Dimple Effect on the Stribeck Curve of Journal Bearings", Tribol Lett, (2007), 27:169-176, DOI, 10.1007/s11249-007-9217-x.

Gulf Publishing Company, Excerpt from "Seals and Sealing Handbook", p. 25.

Khonsari, Michael M., et al., "Applied Tribology, Bearing Design and Lubrication", A Wiley-Interscience Publication, Finite Journal Bearing Design and Analysis, p. 229.

International Search Report, PCT/US2009/037029, dated Oct. 29, 2009, 3 pages.

Written Opinion, PCT/US2009/037029, dated Oct. 29, 2009, 6 pages.

International Search Report, PCT/US2009/037006, Nov. 11, 2009, 3 pages.

Written Opinion, PCT/US2009/037006, Nov. 11, 2009, 7 pages.

* cited by examiner

PATTERNED TEXTURING OF THE SEAL SURFACE FOR A ROLLER CONE ROCK BIT

CROSS-REFERENCE TO RELATED APPLICATIONS

This application is related to U.S. application Ser. No. 12/399,171 filed Mar. 6, 2009 (which claims the benefit of U.S. Provisional Application for Patent Ser. No. 61/036,762 filed Mar. 14, 2008). The disclosures of each of the foregoing applications are hereby incorporated by reference.

TECHNICAL FIELD OF THE INVENTION

The present invention relates generally to earth boring bits, and more particularly to roller cone rock bits.

BACKGROUND

A roller cone rock bit is a preferred cutting tool used in oil, gas, and mining fields to break through the earth formation to shape a well bore. Load and motion of the bit are transferred to the bearings inside three head and cone assemblies. The main journal bearing is composed of the head (as the shaft), the bushing, and the cone (as the housing). This bearing is lubricated and sealed. An outer circumference of the seal is compressed by a gland of the cone so that the seal moves together with the cone and slides against the head (at a sealing surface or seal boss on the head/shaft) on the inner circumference of the seal. The seal is thus confined in the seal gland to secure the lubricant within the bearing and prevent debris from invading into the bearing. The longer the seal excludes contamination from the bearing, the longer the bearing life. Therefore, the seal can become the limiter of the rock bit life.

An elastomer seal is known in the prior art as the dominant sealing element in rock bits. Various types of elastomer seals have been developed. The seal is very flexible, and is compatible with the drilling mud. The seal has excellent resilience at relatively high temperatures. Thus, the seal has proved to be sufficient to provide enough sealing force to separate the mud and debris environment from the lubricant over an acceptable period of time.

However, friction between the seal and surfaces of the seal gland as the cone rotates can cause damage to the seal itself Over time, this damage accumulates to the point where the seal itself fails. Following seal failure, the bearing experiences grease starvation in the contact zone due to loss of lubricant in the bearing system. Thereafter, excessive wear appears on the bearing system surfaces due to shearing and heating caused by sliding friction. The end result is typically scoring, scuffing, and even catastrophic failure like galling or seizure. It is thus imperative that lubrication be retained between contact interface surfaces of the journal bearing. Maintaining seal life is thus critical to maintaining bit life.

One way to extend seal life is to reduce the friction between seal and head. Under typical running conditions, the seal experiences mixed lubrication. In this lubrication regime, more lubricant is necessary at the contact point between the seal and one or more of the gland surfaces in order to reduce the friction. Thus, there is a need in the art to introduce more lubricant in the sealing zone.

Reference is made to FIG. 1 which illustrates a partially broken away view of a typical roller cone rock bit. FIG. 1 more specifically illustrates one head and cone assembly. The general configuration and operation of such a bit is well known to those skilled in the art and will not be described in excessive detail.

The head 1 of the bit includes the bearing shaft 2. A cutting cone 3 is rotatably positioned on the bearing shaft 2 which functions as a journal. A body portion of the bit includes an upper threaded portion forming a tool joint connection 4 which facilitates connection of the bit to a drill string (not shown). A lubrication system 6 is included to provide lubrication to, and retain lubricant in, the journal bearing between the cone 3 and the bearing shaft 2. This system 6 has a configuration and operation well known to those skilled in the art.

A number of bearing systems are provided in connection with the journal bearing supporting rotation of the cone 3 about the bearing shaft 2. These bearing systems include a first cylindrical friction bearing 10 (also referred to as the main journal bearing), ball bearings 12, second cylindrical friction bearing 14, first radial friction (thrust) bearing 16 and second radial friction (thrust) bearing 18.

FIG. 2 illustrates a partially broken away view showing an exemplary bearing system and sealing system in greater detail. The first cylindrical friction bearing 10 is defined by an outer cylindrical surface 20 on the bearing shaft 2 and an inner cylindrical surface 22 of a bushing 24 which has been press fit into the cone 3. This bushing 24 is a ring-shaped structure typically made of beryllium copper, although the use of other materials is known in the art. The ball bearings 12 ride in an annular raceway 26 defined at the interface between the bearing shaft 2 and cone 3.

Reference is once again made to FIG. 1. The second cylindrical friction bearing 14 is defined by an outer cylindrical surface 30 on the bearing shaft 2 and an inner cylindrical surface 32 on the cone 3. The outer cylindrical surface 30 is inwardly radially offset from the outer cylindrical surface 20. The first radial friction bearing 16 is defined between the first and second cylindrical friction bearings 10 and 12 by a first radial surface 40 on the bearing shaft 2 and a second radial surface 42 on the cone 3. The second radial friction bearing 18 is adjacent the second cylindrical friction bearing 12 at the axis of rotation for the cone and is defined by a third radial surface 50 on the bearing shaft 2 and a fourth radial surface 52 on the cone 3.

As shown in greater detail in FIG. 2, with respect to the sealing system, an o-ring seal 60 is positioned between cutter cone 3 and the bearing shaft 2. A sealing surface, for example, a cylindrical surface seal boss 62, is provided on the bearing shaft. In the illustrated configuration, this sealing surface provided by the seal boss 62 is cylindrical and outwardly radially offset (for example, in one implementation by about the thickness of the bushing 24) from the outer cylindrical surface 20 of the first friction bearing 10. It will be understood that the sealing surface (of the seal boss 62 for example) could exhibit no offset with respect to the main journal bearing surface, or be inwardly radially offset, if desired. Additionally, it will be understood that the sealing surface 62 need not be cylindrical but rather may be conical if desired. An annular groove is formed in the cone 3 to define the seal gland 64. The groove and sealing surface (seal boss 62) align with each other when the cutting cone 3 is rotatably positioned on the bearing shaft to define the gland 64 region. The o-ring seal 60 is compressed between the surface(s) of the gland 64 and the sealing surface (seal boss 62), and functions to retain lubricant in the bearing area around the bearing systems and prevents any materials (drilling mud and debris) in the well bore from entering into the bearing area. In a conventional prior art implementation, the seal boss 62 surface is a machined or polished surface.

Load in the bearing system is supported by both asperity contact and hydrodynamic pressure. Lubricant is provided in the first cylindrical friction bearing 10, second cylindrical friction bearing 14, first radial friction bearing 16 and second radial friction bearing 18 between the various cylindrical and radial surfaces using the system 6. Lubricant is retained in the bearing system by the compressed seal 60 in the gland 64. That lubricant not only lubricates the bearing system, but also provides a measure of lubricant on the surfaces of the seal gland 64 itself, and especially the sealing surface such as the seal boss 62 surface, that assists in allowing the compressed seal 60 to slide along the sealing surface (for example, seal boss 62 outer cylindrical surface) as the cone 3 and seal 60 rotate together.

The seal is designed to withstand a high pressure in downhole drilling applications. That high pressure, together with a designed high compression rate of the seal in gland, compresses the seal tightly against the seal boss 62. The lubricant which is present in the sealing zone at the seal boss surface provides lubrication to the seal and takes away friction heat. In the case where the seal is not well lubricated, it slides dry against the seal boss and a large amount of friction heat is generated. This friction heat is known to be the root cause of seal failure. It is accordingly desirable to introduce more lubricant underneath the seal, such as on the seal boss 62 surface (or any other sliding gland surface), in order to reduce friction and carry away heat.

SUMMARY

To address issues of grease starvation and possible seal failure, it is desired to increase the amount of lubricant that can be maintained in the surface contact zones of the sealing system. In an effort to introduce more lubricant into these surface contact zones, the surface topography of the sealing system (for example, seal gland surfaces) is modified from the conventional machined or polished surfaces of the prior art.

In an embodiment, a patterned surface texture is introduced, preferably on the seal boss cylindrical surface at the seal location, to the sealing system for the roller cone rock bit. The patterned surface texturing functions to retain additional lubricant and is thus helpful to reduce friction at the seal.

In a preferred implementation, the surface texture comprises a plurality of non-overlapping dimples or other reservoir-like like structures (texture features) arranged in desired pattern (such as a repeating or regular pattern, as provided, for example, in an array). Each dimple behaves as a lubricant reservoir which can hold more lubricant at the seal surface than if the seal surface were simply a ground or polished (or otherwise typically treated surface) as in the prior art. Preferably, the included dimples have a uniform size and shape.

In an embodiment, a regular pattern of surface texture features is employed to modify the topography of one or more sliding surfaces (radial, conical or cylindrical) of the sealing system for a rock bit. The surface texture features assist in permeating lubrication into inter-space or metal asperities. In addition, higher hydrodynamic pressure is generated in the area of the surface texture features.

The non-overlapping individual surface texture features are arranged on the sealing surface in a pattern. One pattern that may be used is an array pattern. Another pattern that may be used is an offset array pattern. In the context of the present invention, the use of the term "pattern" refers specifically to a non-random arrangement of the non-overlapping surface texture features. A regular or repeating pattern would comprise an example of the non-random arrangement of individual surface texture features in accordance with the invention. In this context, the pattern arrangement of the surface texture features repeats along a circumference (inner or outer) of the sealing surface.

An individual surface texture feature may have any desired plan geometric shape. However, circular or elliptical shapes are preferred. Polygonal shapes, such as triangular, square, pentagonal, hexagonal, etc., may alternatively be selected.

The individual surface texture features may have a depth ranging from 3 to 300 microns. The diameter or width of the individual surface texture features may range from 15 to 1000 microns.

The density of the textured (dimpled) surface area, defined as the surface area of the non-overlapping features themselves divided by the total area where that patterned texturing is provided, must be controlled. As feature (dimple) density increases, the contact area between the seal and the sliding seal surface is reduced. If contact area is reduced below a critical amount, due to increased feature density, there is an increase in interface contact pressure which may result in increased wear (in spite of the presence of additional lubricant). Thus, it is preferred that the density of textured (dimpled) surface area be controlled to a range from 3-60%. The occupied surface area which has patterned surface texture features may range from 3-100%, it being preferred that the occupied surface are be relatively high.

As a specific example, the surface texture features may comprise a repeating pattern of non-overlapping dimples formed on the surface with an array or offset array configuration. Each dimple has a generally round plan geometric shape with a depth selected between 20 to 30 microns and a diameter selected between 100 to 200 microns. The surface area where the dimples are formed is about 100% of the functional surface area of the sliding seal. The density of the dimpled surface area, defined as the surface area of the dimples themselves divided by the total area where patterned texturing is provided, is about 15-20%.

Although it is preferred to include the patterned surface texture about the circumference of the sliding seal surface(s), such as on the seal boss cylindrical surface at the seal and gland location, it is further understood that the patterned surface texture may be used on other surfaces of the seal gland, including non-sliding surfaces, radial surfaces, cylindrical surfaces and conical surfaces.

The patterned surface texturing as described herein creates a pattern of reservoir-like features, such as dimples, on one or more surfaces of the sealing system. With reference once again made to FIG. 2, the textured surface in the sealing system in accordance with embodiments described herein is preferably the seal boss 62 surface. It will be understood, however, that depending on the configuration of the gland 64, one or more other surfaces associated with defining the gland and compressing the seal 60 could have a surface texturing as well. Thus, any desired surface, including cylindrical, conical and radial surfaces, of the gland 64 area for the sealing system could possess a surface texturing. Furthermore, any combination of textured surfaces, with untextured surfaces, may be used in the sealing system.

The dimples of the surface texturing behave as lubricant reservoirs which permeate the lubrication into the inter-space of metal asperities. Meanwhile, higher hydrodynamic pressure is generated on the dimple area. Both functions will facilitate an improvement in sealing system lubrication with a reduction in friction.

Embodiments herein utilize any one or more of a variety of methods to create the patterned surface texturing including: machining, chemical etching, laser texturing, deep rolling, vibratory finishing, etc. Controllability, uniformity, cost, coverage area, dimple size, dimple depth, and dimple shape are the factors which determine which method is selected to form the texturing.

DETAILED DESCRIPTION OF THE DRAWINGS

Surface texturing is employed to modify the topography of one or more surfaces (radial, conical or cylindrical or other) of the sealing system for a roller cone rock bit. The surface texturing produces a patterned dimpled surface, wherein each dimple retains additional lubricant helpful in reducing friction in the boundary and mixed lubrication regimes. Surface coverage area for the dimpled texture may be between 3-100%, but more preferably should exceed 60%, more preferably be between 70-90%, and even more preferably approach or reach approximately 100%. The density of the dimpled surface area, defined as the surface area of the dimples themselves divided by the total area where patterned texturing is provided, is between 3-60%, but more preferably should be about 15-20%.

Figure 1:
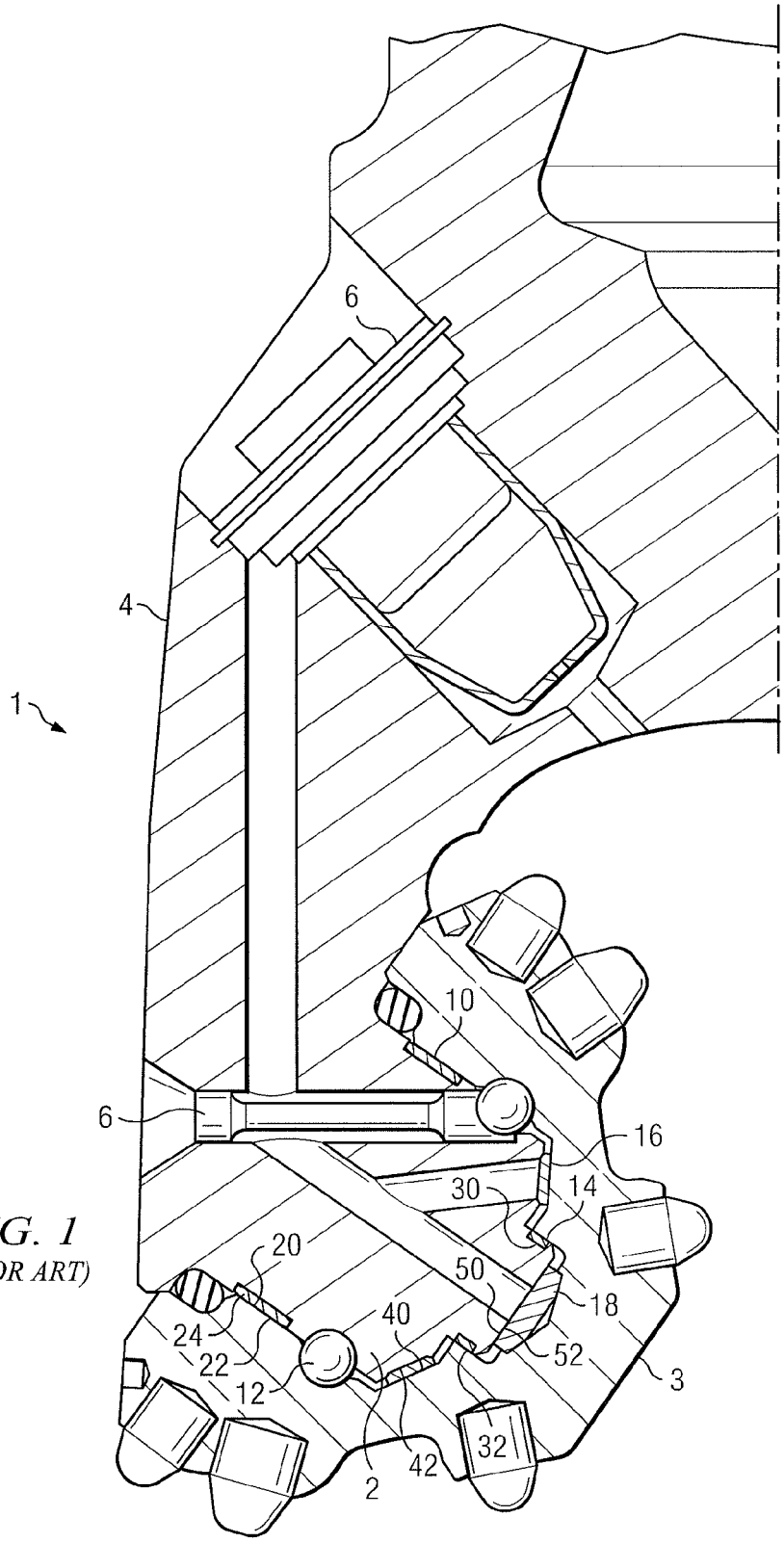
FIG. 1 (PRIOR ART)
FIG. 1 illustrates a partially broken away view of a typical roller cone rock bit.
Figure 2:
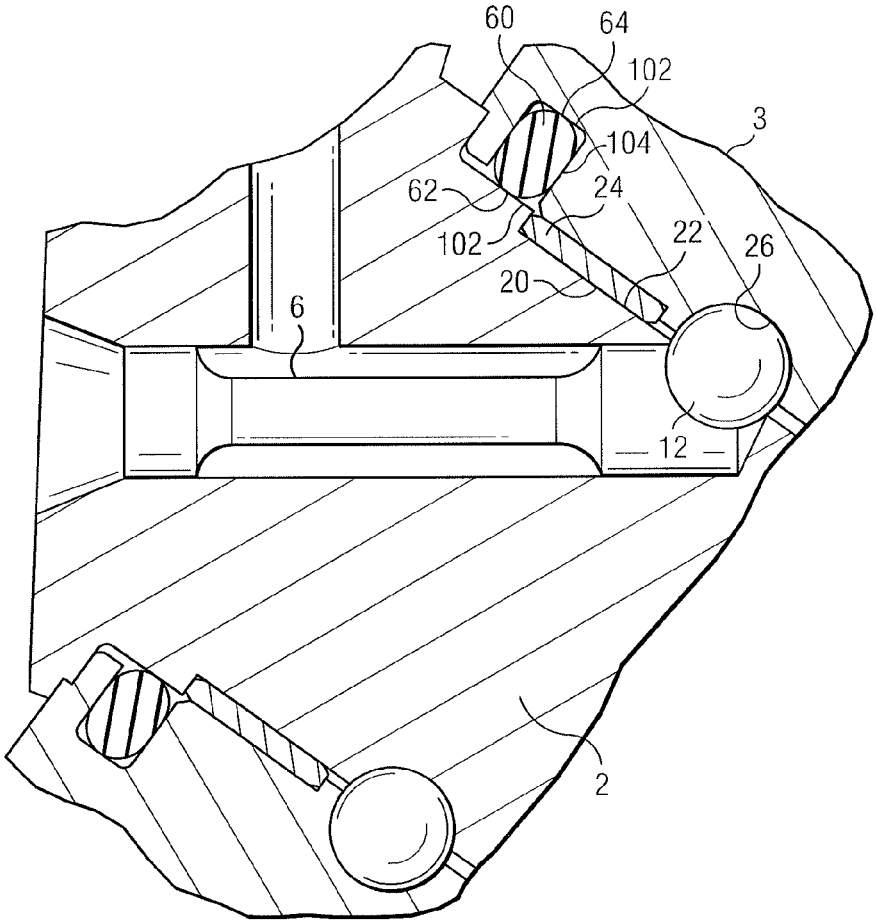
FIG. 2 illustrates of a partially broken away view of another typical roller cone rock bit.

With reference to FIG. 2, the textured surfaces in the sealing system to which this patterned surface texturing is applied preferably comprise any surface having sliding contact with the seal 60 as the cone rotates. This would include one or more surfaces of the gland 64. More specifically, it would at least include the seal boss 62 surface. Any combination of patterned textured surfaces with desired untextured surfaces may alternatively be used.

Figure 2A:
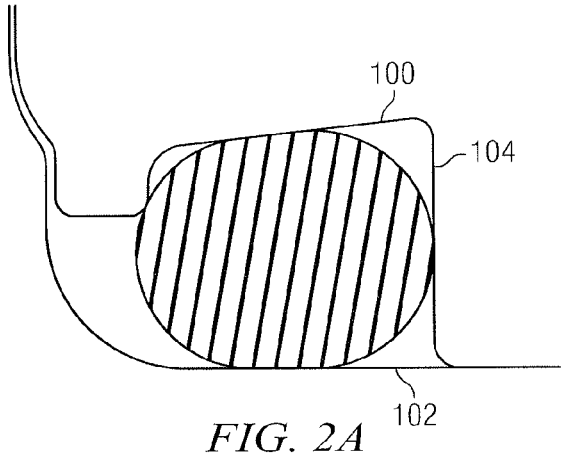
FIGS. 2A-2C illustrate other geometries for a sealing system used in FIG. 2.
Figure 2B:
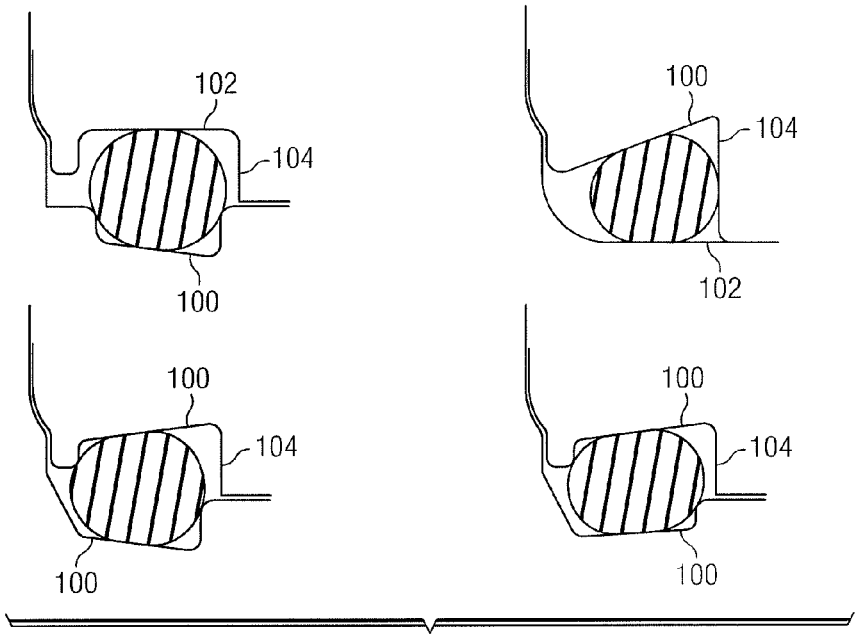
Figure 2C:
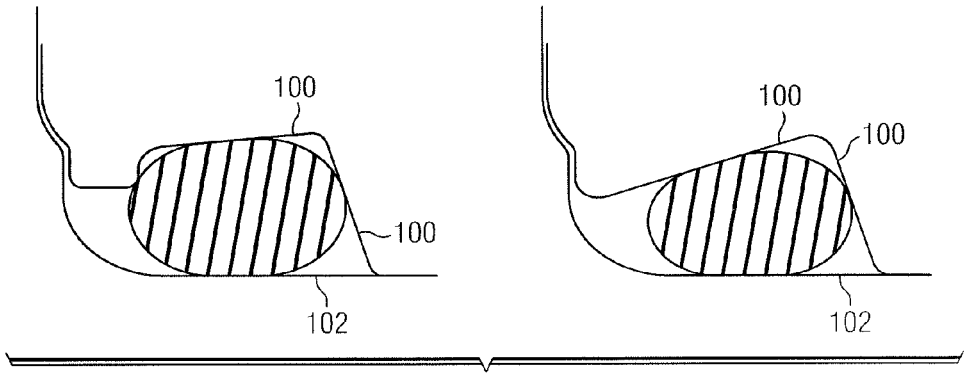

While FIG. 2 illustrates the use of cylindrical sealing surfaces associated with the boss 62 and gland 64, with the patterned surface texturing being applied to the cylindrical seal boss 62 surface, the patterned surface texturing may additionally be applied to other gland geometries for the sealing system such as those illustrated in FIGS. 2A-2C. It will be noted that these alternative gland geometries exploit conical surfaces 100 in connection with the sealing system (on either one of or both of the shaft and cone side of the seal). Thus, any conical surface 100 or cylindrical surface 102 associated with the seal and functioning as a sealing surface against which the seal 60 slides or rides or touches as the cone rotates is a suitable candidate for texturing. The radial surfaces 104 of the gland, especially if they make contact with the seal, may also be textured.

The dimples of the surface texturing behave as lubricant reservoirs which permeate the lubrication into inter-space of metal asperities. Meanwhile, higher hydrodynamic pressure is generated on the dimple area. Both functions will facilitate an improvement in sealing and/or bearing system lubrication.

Any one or more of a variety of methods can be used to create the dimpled surface texturing including: machining, chemical etching, laser texturing, deep rolling, vibratory finishing, etc. Controllability, uniformity, cost, coverage area, dimple size, dimple depth, and dimple shape factors which influence which method is selected for the surface texturing process.

The dimpled surface texture is non-random and exhibits a pattern. The pattern is preferably regular and/or repeating. Preferably, the individual features included in the pattern exhibit a uniform size and shape. The pattern presented by the individual features repeats along a circumference (inner or outer) of the sealing surface to which the pattern is applied. Furthermore, an individual texture feature in the pattern does not overlap with any other individual texture feature.

Figure 3A:
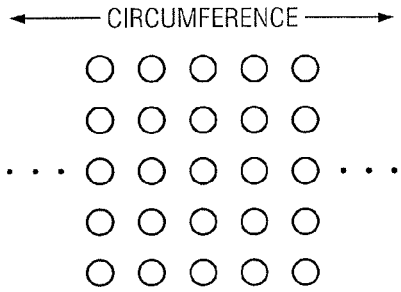
FIGS. 3A-3E illustrate exemplary patterns of surface texture features.
Figure 3B:
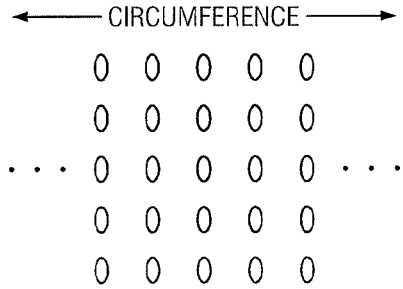
Figure 3C:
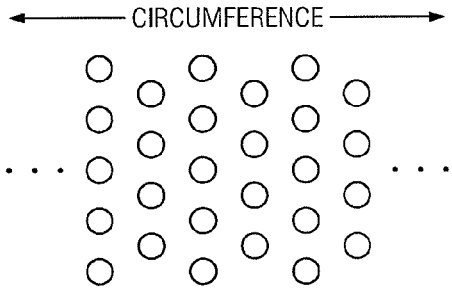
Figure 3D:
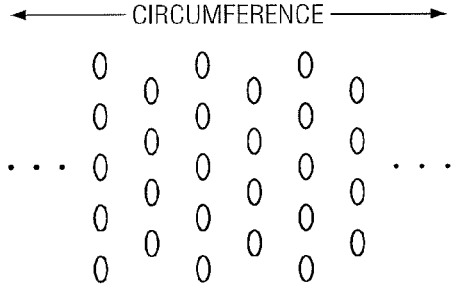
Figure 3E:
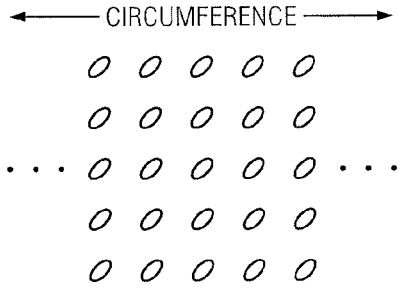

FIGS. 3A-3E illustrate portions of exemplary patterns of surface texture features, where those included features have a uniform size and shape. The individual surface texture features may have a depth ranging from 3 to 300 microns. The diameter or width of the individual surface texture features may range from 15 to 1000 microns. It will be understood that the portions illustrated in FIGS. 3A-3E repeat along a circumference (inner or outer) of the sealing surface to which the pattern is applied (the circumference coinciding with the direction of the sliding movement of sealing surface against the seal). FIG. 3A shows an array pattern of features, wherein each feature has a circular plan shape. FIG. 3B shows an array pattern of features, wherein each feature has an elliptical (or oval) plan shape. FIG. 3C shows an offset array pattern of features (also referred to as hexagonal array), wherein each feature has a circular plan shape. FIG. 3D shows an offset array pattern of features (also referred to as hexagonal array), wherein each feature has an elliptical plan shape. FIG. 3E shows an array pattern of features, wherein each feature has an elliptical (or oval) plan shape, and the orientation of each feature is set at about 45°. The orientation angle of 45° is exemplary only, and the angle may be selected at any desired value between 0° and 90°. Although not specifically illustrated in FIGS. 3A-3E, it will be understood that polygonal shapes, such as triangular, square, pentagonal, hexagonal, etc., may alternatively be selected for the surface texture features.

In summary, a surface textured sealing system is presented for use in a rock bit. Tiny dimples are formed on one or more surfaces of interest in connection with the sealing system (for example, the seal boss or other sliding surface with respect to the seal). The dimples have a non-random distribution (pattern). The dimples preferably have a uniform size. The surface texturing is provided over the surface of interest (for example with a coverage of between 3-100% of the surface, and more preferably at least 60% of the surface). The density of the dimpled surface area, defined as the surface area of the dimples themselves divided by the total area where patterned texturing is provided, is between 3-60%, but more preferably is about 15-20%. The dimples work as reservoirs to constrain more lubricant in the surface contact zone. Hydrodynamic pressure is generated in the dimple area and the seal friction is reduced. Correspondingly, the sealing working condition is improved.

Embodiments of the invention have been described and illustrated above. The invention is not limited to the disclosed embodiments.

What is claimed is:

1. A sealing system for a bearing of a rock bit, comprising:

a gland;

a shaft; and a seal positioned in the gland and compressed by the gland against the shaft at a sealing surface on the shaft, wherein the sealing surface includes a surface texturing comprised of a plurality of non-overlapping surface texture features arranged in a repeating pattern, wherein the surface texture features are reservoir-like structure.

2. The sealing system of claim 1, wherein the repeating pattern is an array pattern.

3. The sealing system of claim 1, wherein the repeating pattern is an offset array pattern.

4. The sealing system of claim 1, wherein the surface texture features have a uniform size and shape.

5. The sealing system of claim 1, wherein surface texture features comprise dimples.

6. The sealing system of claim 5, wherein the dimples have a circular plan shape.

7. The sealing system of claim 5, wherein the dimples have an elliptical plan shape.

8. The sealing system of claim 1, wherein the surface texture features have a uniform size and shape, and a depth of between 3 and 3000 microns.

9. The sealing system of claim 8, wherein the depth is 20-30 microns.

10. The sealing system of claim 1, wherein the surface texture features have a uniform size and shape, and a width or diameter of 15-1000 microns.

11. The sealing system of claim 10, wherein the width or diameter is 100-200 microns.

12. The sealing system of claim 1, wherein a density of textured surface area for the surface texture features is between 3-60%.

13. The sealing system of claim 12, wherein the density of textured surface area is 15-20%.

14. The sealing system of claim 1, wherein a percentage of the sealing surface covered with surface texture features is 3-100%.

15. The sealing system of claim 14, wherein the percentage is greater than 60%.

16. The sealing system of claim 15, wherein the percentage is about 100%.

17. The sealing system of claim 1, wherein the sealing surface is a cylindrical surface of the shaft.

18. The sealing system of claim 1, wherein the sealing surface is a conical surface of the shaft.

19. An apparatus, comprising:

a shaft including a first seal surface;

a roller cone having an annular gland including a second seal surface;

wherein the roller cone is rotatably mounted to the shaft such that the annular gland aligns with the first seal surface;

a seal ring compressed between the first and second seal surfaces within the annular gland; and wherein at least one of the first and second seal surfaces includes a surface texturing comprised of a plurality of non-overlapping surface texture features arranged in a pattern which repeats along a circumference of the at least one of the first and second seal surfaces, the surface texture features being reservoir-like structure.

20. The apparatus of claim 19, wherein the first seal surface includes the surface texturing and the first seal surface is a cylindrical surface.

21. The apparatus of claim 19, wherein the first seal surface includes the surface texturing and the first seal surface is a conical surface.

22. The apparatus of claim 19, wherein the second seal surface includes the surface texturing and the second seal surface is a cylindrical surface.

23. The apparatus of claim 19, wherein the first seal surface includes the surface texturing and the second seal surface is a conical surface.

24. The apparatus of claim 19, wherein the repeating pattern is an array pattern.

25. The apparatus of claim 19, wherein the repeating pattern is an offset array pattern.

26. The apparatus of claim 19, wherein the surface texture features have a uniform size and shape.

27. An apparatus, comprising:

a shaft including a first seal surface;

a roller cone having an annular gland including a second seal surface;

wherein the roller cone is rotatably mounted to the shaft such that the annular gland aligns with the first seal surface;

a seal ring compressed between the first and second seal surfaces within the annular gland; and wherein at least one of the first and second seal surfaces includes a surface texturing comprised of a plurality of non-overlapping surface texture features arranged in a non-random pattern extending about a circumference of the at least one of the first and second seal surfaces, the surface texture features being reservoir-like structure.

28. The apparatus of claim 27, wherein the at least one of the first and second seal surfaces is in sliding contact with the seal ring.

* * * * *